US008656991B2

(12) United States Patent
Farrar et al.

(10) Patent No.: US 8,656,991 B2
(45) **Date of Patent: *Feb. 25, 2014**

(54) CLOG FREE HIGH VOLUME DRILL CUTTING AND WASTE PROCESSING OFFLOADING SYSTEM

(71) Applicant: KMC Oil Tools B.V., Amsterdam (NL)

(72) Inventors: Joseph Daniel Farrar, Houston, TX (US); Perry Don Lyman, Houston, TX (US)

(73) Assignee: KMC Oil Tools B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/848,445

(22) Filed: Mar. 21, 2013

(65) Prior Publication Data

US 2013/0228380 A1 Sep. 5, 2013

Related U.S. Application Data

(63) Continuation-in-part of application No. 13/498,481, filed as application No. PCT/US2010/050315 on Sep. 25, 2010.

(60) Provisional application No. 61/246,494, filed on Sep. 28, 2009.

(51) Int. Cl.
*E21B 21/06* (2006.01)

(52) U.S. Cl.
USPC ..... 166/207; 166/66; 166/206

(58) Field of Classification Search
USPC ..... 175/66, 206, 207
See application file for complete search history.

(56) References Cited

U.S. PATENT DOCUMENTS

| | | | | |
|---|---|---|---|---|
| 5,053,082 | A * | 10/1991 | Flanigan et al. | 134/25.1 |
| 5,944,418 | A * | 8/1999 | Orr et al. | 366/245 |
| 6,244,362 | B1 | 6/2001 | Williams | |
| 6,508,583 | B1 * | 1/2003 | Shankwitz et al. | 366/196 |
| 6,530,438 | B1 | 3/2003 | McIntyre | |
| 6,585,115 | B1 | 7/2003 | Reddoch et al. | |
| 7,404,454 | B2 * | 7/2008 | Hulick | 175/26 |
| 2003/0217866 | A1 | 11/2003 | deBoer | |
| 2004/0129611 | A1 | 7/2004 | Whitsel et al. | |
| 2005/0153844 | A1 | 7/2005 | McIntyre | |
| 2005/0242003 | A1 | 11/2005 | Scott et al. | |
| 2006/0086676 | A1 | 4/2006 | Smith | |
| 2006/0102390 | A1 | 5/2006 | Burnett et al. | |
| 2006/0185236 | A1 | 8/2006 | Hill | |
| 2007/0131454 | A1 * | 6/2007 | Hollier et al. | 175/66 |
| 2007/0131592 | A1 | 6/2007 | Browne et al. | |
| 2007/0183853 | A1 * | 8/2007 | Eide | 406/122 |
| 2012/0181086 | A1 | 7/2012 | Addison et al. | |

* cited by examiner

*Primary Examiner* — Giovanna Wright
*Assistant Examiner* — Richard Alker
(74) *Attorney, Agent, or Firm* — Buskop Law Group, PC; Wendy Buskop

(57) ABSTRACT

A clog free waste removal system for removing waste or drilling cuttings from a wellbore at the rate that waste is being produced having an incoming transportation system, a rig buffer, and optional surge tank, an outgoing transportation system, and post treatment device or transport.

18 Claims, 12 Drawing Sheets

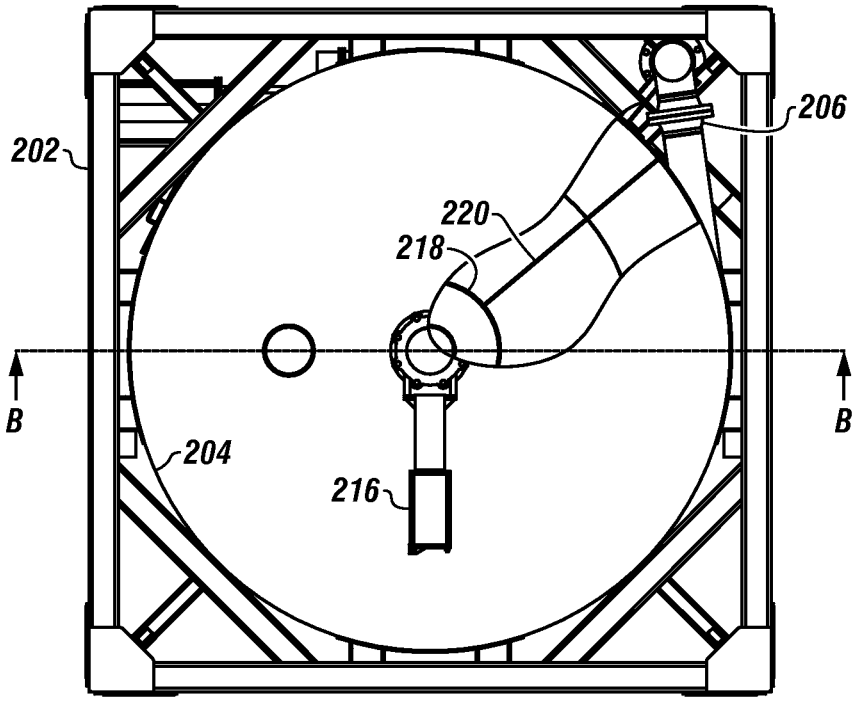
FIGURE 10A
FIGURE 10B
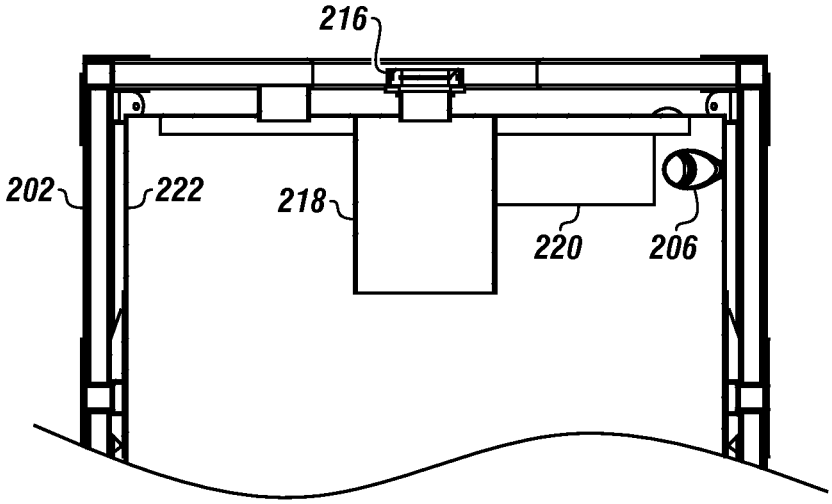

CLOG FREE HIGH VOLUME DRILL CUTTING AND WASTE PROCESSING OFFLOADING SYSTEM

CROSS REFERENCE TO RELATED APPLICATION

The current application is a continuation in part and claims priority to co-pending U.S. patent application Ser. No. 13/498,481 filed on Mar. 27, 2012, entitled "DRILL CUTTINGS METHODS AND SYSTEMS," which is a 371 filing of PCT/US2010/050315 filed on Sep. 25, 2010, which claims priority to and the benefit of U.S. Provisional Patent Application Ser. No. 61/246,494 filed on Sep. 28, 2009. This reference is hereby incorporated in its entirety.

FIELD

The present embodiments generally relate to a drill cutting and waste removal system for removing waste from a wellbore at the rate that the rig is drilling.

BACKGROUND

A need exists for a clog free high volume drill cuttings and waste processing system that enables accelerated offloading of drill cutting and waste to a transport vessel or for post treatment.

The present embodiments meet these needs.

BRIEF DESCRIPTION OF THE DRAWINGS

The detailed description will be better understood in conjunction with the accompanying drawings as follows:

FIG. 10A depicts a cut away view of an upper portion of the tank of the rig buffer storage depicting the tangential entry of the inlet.

FIG. 10B depicts a sectional view of the upper portion of the tank of FIG. 10A.

Figure 1A:
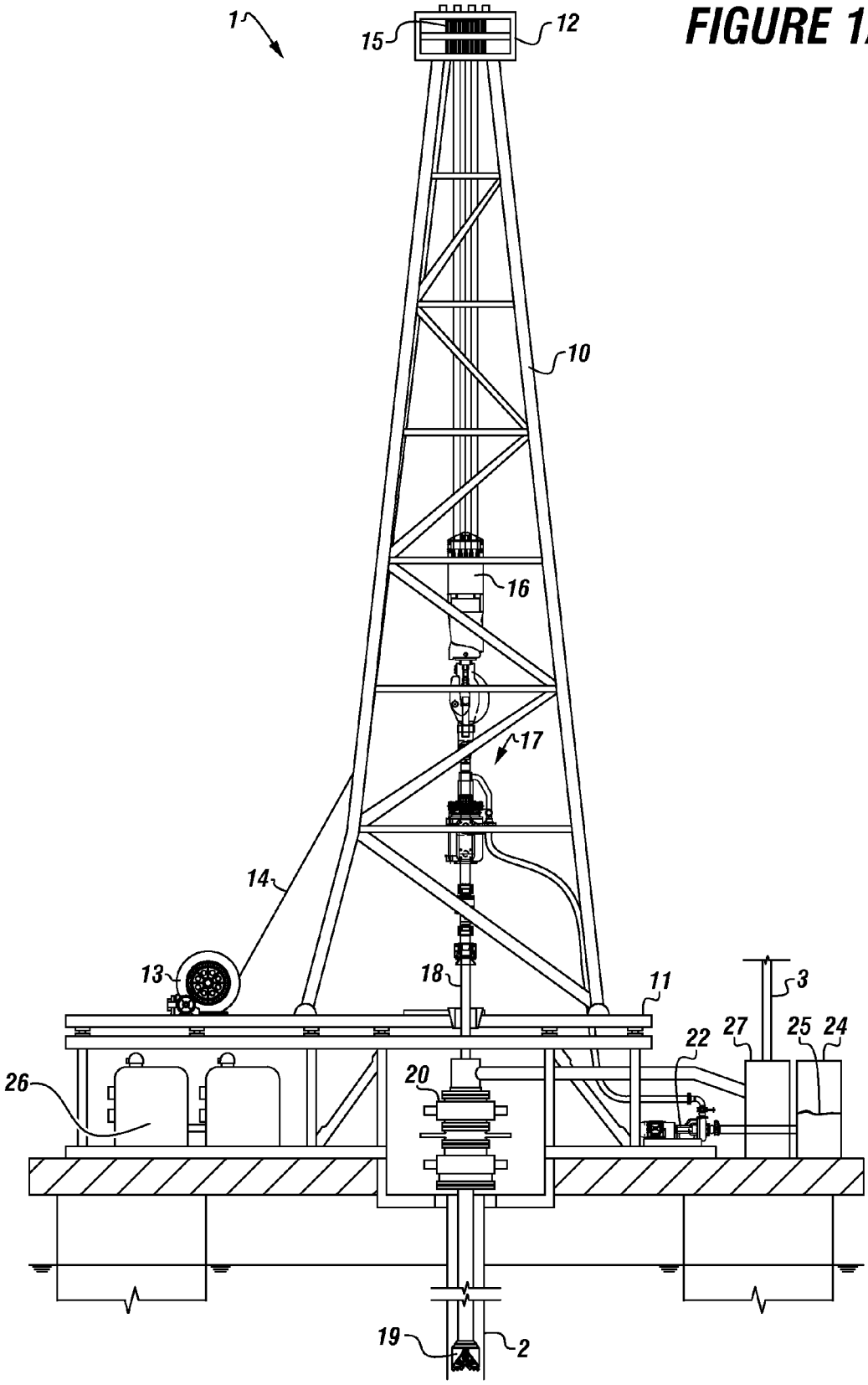
FIG. 1A is a representation of an offshore oil rig usable with an embodiment of the present invention.

The present embodiments are detailed below with reference to the listed Figures.

DETAILED DESCRIPTION OF THE EMBODIMENTS

Before explaining the system and method in detail, it is to be understood that the system and method are not limited to the particular embodiments and that it can be practiced or carried out in various ways.

The present invention helps prevent toxic waste being in contact with humans on an offshore oil rig, and prevent spill of waste into the sea, or land, if the rig is land based.

Waste, such as drilling fluid, namely drilling mud, on the decks of offshore rigs creates a slip hazard. The present closed loop waste treatment transportation system provides a closed environment for transporting waste that helps keeps rigs safer for roughnecks and crew.

The closed loop system for waste treatment lowers the risk of permanent paralysis of a person working on a rig and lowers the chance of a head injury for a person working on a rig by eliminating the need to lift a box of waste off a rig.

In labor costs, and energy costs, the present invention eliminates the need to do 100's of lifts of waste boxes for removal of waste from the rig, over the life the well. This rig with waste transport system saves thousands of man hours over the life of a well reducing hours of potentially hazardous duty to rig and offshore service vessel personnel.

Problems exist and could exist regarding use of waste boxes from rigs for waste removal. Boxes of waste have been dropped. The present invention eliminates boxes from being dropped to remove waste.

Studies have been done on the dangers of lifting boxes of waste from offshore oil drilling platforms, and the dangers have been identified related to boxes being dropped.

Danger potentially exists when a dropped box could fall on people breaking bones, causing head injuries and limb damage.

The boxes typically weigh 10 tons when full and when lifted from the rig. The present invention avoids the need for these waste boxes.

It is contemplated that if a box fell on a person directly, it could kill them. The present system avoids this potential death.

Waste boxes which could be 10 tons filled, could drop through the decks of rig tenders, severely damaging the tender or sinking them. The invention prevents damaging and sinking of tenders to offshore vessels.

The invention saves over 415 metric tons per year of $CO_2$ emissions for a rig annually as compared to currently available waste transportation systems. This calculation has been determining using the U.S. Environmental Protection Agency website EPA.gov when inserting the low horsepower needed by the present invention as compared to a commercially available unit.

The invention uses a fuel efficient low horsepower, 30 hp as compared to the conventional 120 hp, for retrieval of cuttings from a rig buffer storage, which enables significant savings on hundreds of tons of $CO_2$ emissions.

The present system allows oil and natural gas rigs to continue drilling operations when the weather prevents offshore service vessels from being alongside a rig for removal of cuttings.

The current invention allows a rig to continuously operate by allowing continuous waste transport removal, saving day rates of $500,000 to $1,000,000 by keeping the rigs operating even in bad weather, such as a storm with a wave height exceeding 3 meters. The making the drilling rig more efficient, and by continuing the drilling operation, this unique system reduces CO2 emission over the life of the well.

The invention relates to a system with rig buffer storage and optional surge tank for receiving and processing drill cuttings and waste made for example, by a drilling rig.

The rig buffer storage has a tank in a frame with an inlet and an outlet, a moveable weir for expanding to accommodate additional drill cuttings, a central sweep member for cutting the drill cuttings and waste opposite a peripheral outer ring with peripheral cutting members, allowing bidirectional cuttings, a controller for controlling rates of flow into and out of the rig buffer storage and the central sweep member rotation via a motor with reduction gear and further having a first transportation system for moving waste from the wellbore to the rig buffer storage and a second transportation system for moving cut waste and cut drill cuttings to a post treatment system, a skip, or a vessel, ultimately for transport to another location.

Figure 1B:
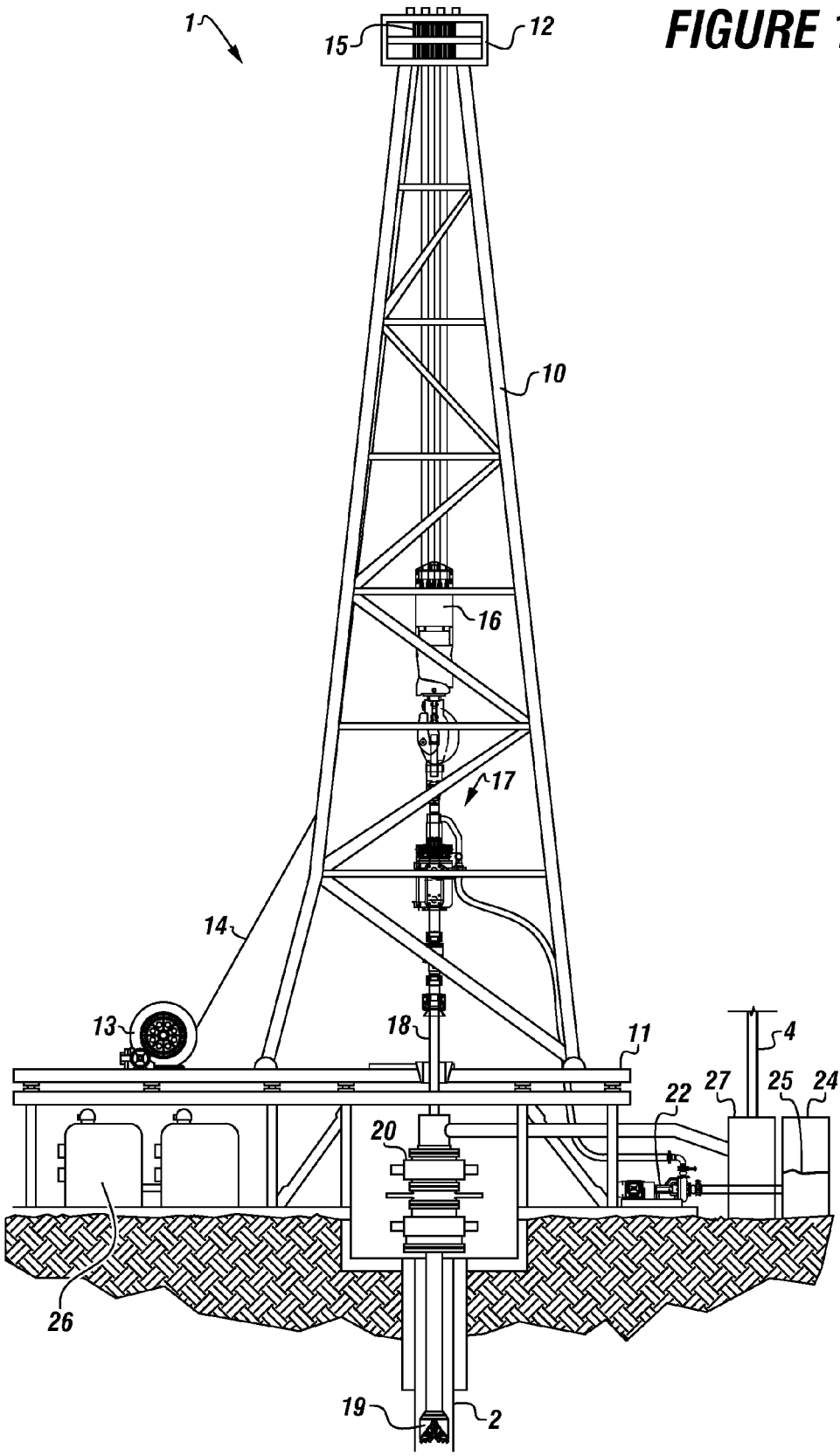
FIG. 1B is a representation of a land based oil rig usable with a surge tank and a rig buffer storage system.

Turning now to the Figures, FIG. 1A is representation of an offshore oil rig usable with an embodiment of the present invention. FIG. 1B is a representation of a land based oil rig usable with an embodiment of the present invention wherein a surge tank fluidly connected to a rig buffer storage will be used on the rig.

FIGS. 1A and 1B show an oil and natural gas drilling or production rig 1 usable with the system.

The oil and natural gas drilling or production rig 1 can have a derrick 10 with a deck 11. The derrick 10 can have crown block 12 above the deck 11.

A drawworks 13 with cable 14, wherein the cable 14 connects the drawworks over the crown block 12 through sheaves 15 to a traveling block 16.

A top drive 17 can be attached to the traveling block 16. A tubular 18 can be attached to the top drive 17.

A drill bit 19 can be secured to the tubular 18 opposite the top drive 17 for drilling a wellbore 2.

A blowout preventer 20 is shown connected between the drill bit 19 and the top drive 17.

A mud pump 22 is connected to a mud reservoir 24 for flowing drilling mud 25 contained in the mud reservoir to the top drive 17 then through to the tubular 18 to the drill bit 19. The drilling mud then is flowed back up the wellbore 2 to a solids removal system 27 for separating drill cuttings and waste from the drilling mud. A typical solids removal system can be a shaker system such as those made by Scomi Equipment Inc. of Houston, Tex.

A rig power generation plant 26 is connected to the mud pump 22, a drawworks 13, and the top drive 17.

A first incoming transportation system 3 shown in FIG. 1A receives separated drill cuttings or waste or combinations thereof, from the solids removal system 27.

A second incoming transportation system 4 shown in FIG. 1B receives separated drill cutting or waste or combinations thereof form the solids removal system 27.

The incoming transportation systems 3 and 4 can be a dense phase conveyance system (also known as a "DPCS"), a vacuum conveyance system, a dilute conveyance system, an auger, or combinations of these conveyance systems.

The incoming transportation systems can be mounted to the deck in embodiments wherein the rig is an offshore vessel. The term "deck" as used herein for land based rigs, can refer to the rig floor, the substructure or an oil field mat.

Figure 2:
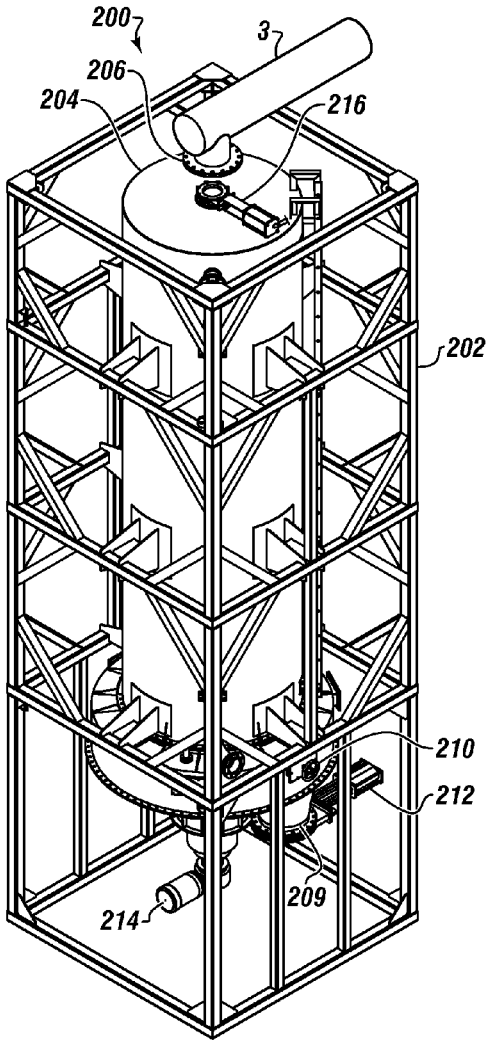
FIG. 2 is an oblique view of a rig buffer storage usable in embodiments of the present invention.
Figure 3:
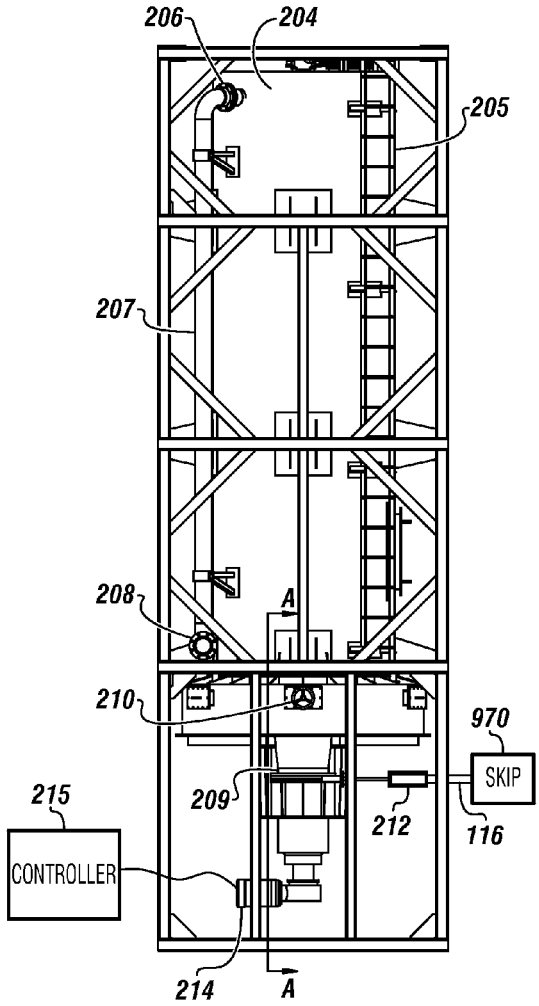
FIG. 3 is a side view of a rig buffer storage usable in embodiments of the present invention.

FIG. 2 is a view of a rig buffer storage usable in embodiments of the present invention. FIG. 3 is a side view of the rig buffer storage usable in embodiments of the present invention.

Rig buffer storage 200 can be disposed on the deck of the oil and natural gas drilling or production rig. The rig buffer storage 200 can receive the drill cuttings or waste or both from the first incoming transportation system 3.

The rig buffer storage 200 can have a lifting frame 202. The lifting frame 202 in embodiments can be fastened to the deck or to the rig floor. The lifting frame 202 can support a tank 204.

The tank 204 can receive drill cuttings or waste from a first incoming transportation system 3 via an upper tank inlet 206, a lower tank inlet 208 or combinations thereof. The tank 204 can have a vent valve 216 that controls venting of the tank.

The tank 204 can have a discharge port 209 through which drill cuttings or cut waste is flowed. A discharge valve 212 can be connected to the discharge port 209.

On the outside of the tank 204 is a weir controller 210 that controls or adjusts a height of a moveable weir in the tank.

The height can be adjusted from 6 inches to 18 inches in an embodiment allowing the weir to become flush with the top of a central sweep member in the tank or raised up to allow for easier flow of drill cuttings and waste to the central sweep member in the tank.

Weir controller 210 is depicted as a rotatable mechanical wheel, but in embodiments can be an electronic controller connected to a motor for raising or lowering the moveable weir.

In embodiments, the tank receives the drill cuttings and processes them at the same rate that the well is operating, at a rate a post treatment unit can handle, or a tendered floating vessel can handle.

In embodiments, this system can handle drill cuttings from 15 cubic meters of cuttings per hour to 60 or more cubic meters of cuttings per hour.

A low horsepower controllable central sweep motor 214 can connect to and operate a central sweep member for rotating a plurality of blades.

A controller 215 is depicted in communication with the low horsepower controllable central sweep motor 214. The controller can also be in communication with the vent valve and the discharge valve.

FIG. 3 further shows the tank 204 with a ladder 205.

A transport line 207 is depicted for flowing waste up and into the upper portion of the tank from a lower tank inlet 208, creating agitation and non-laminar flow and to fill the tank.

A first outgoing transportation device 116 is shown connected to the tank. The first outgoing transportation device can be a dense phase conveyance system (also known as a "DPCS") such as a CBP-800 made by Scomi Equipment, a vacuum conveyance system such as the Scomi Equipment rig vac system, a dilute conveyance system such as those made by Scomi Equipment, an auger such as a 12 inches to 18 inch diameter auger with a variable length, or combinations thereof, for communicating cut waste or drill cuttings from the tank.

The first outgoing transportation device 116 is shown flowing waste to a skip 970. The skip can be moveable and relocatable. The skip 970 can be positioned on the deck, for receiving the cut waste or drill cuttings from the first outgoing transportation device 116. Skips can be those provided by Scomi Equipment, known as cuttings skips, and can hold up to 10 ton of waste.

In one or more embodiments, the skip can be a post treatment device can be a thermal treatment system enabling the drill cuttings or waste to be disposed of at sea.

Figure 4:
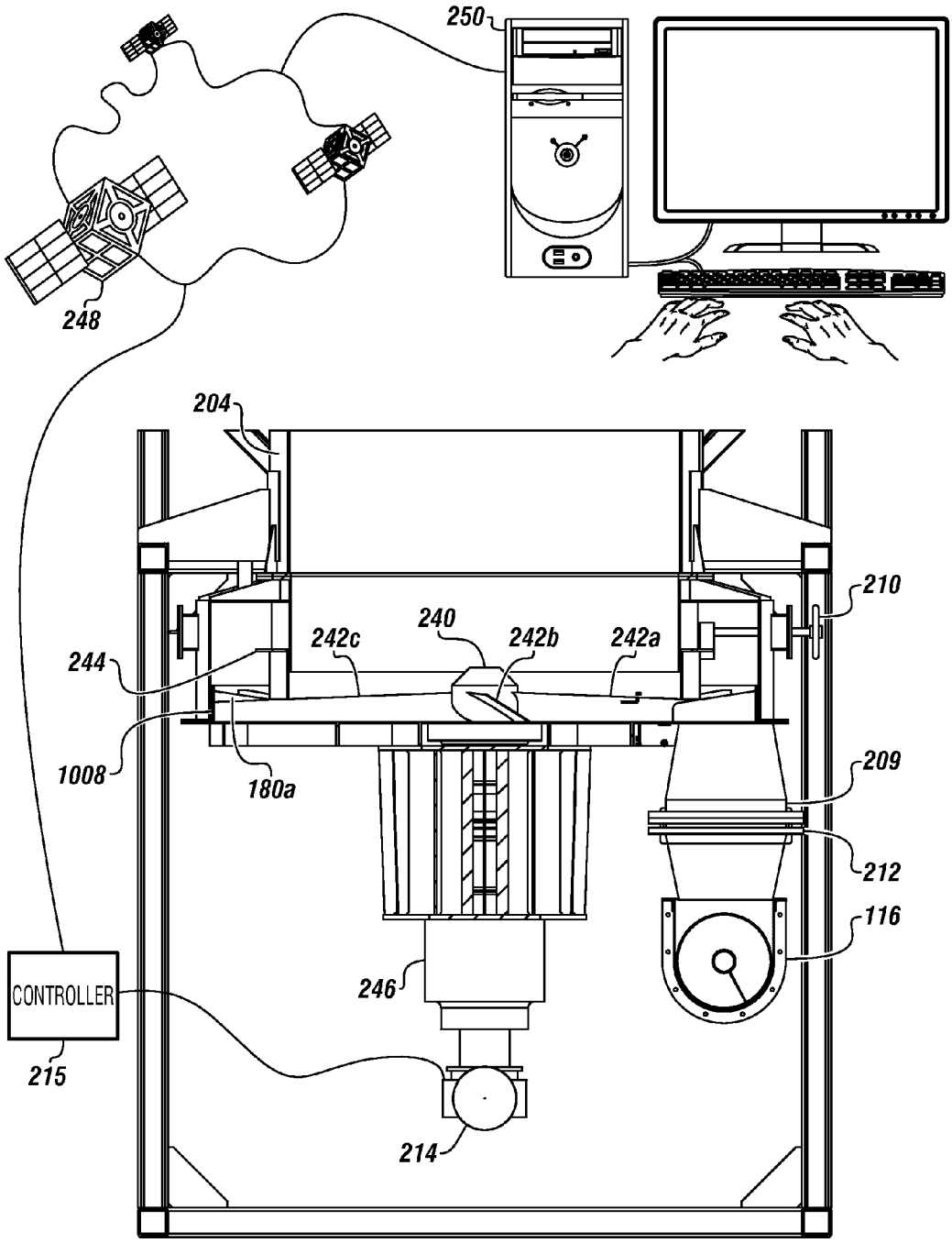
FIG. 4 is a sectional view of a portion of the rig buffer usable in embodiments of the present invention.

FIG. 4 depicts a central sweep member 240 having a plurality of blades 242*a*-242*c* for cutting segments of drill cuttings or waste in the tank 204. Four blades can be used, though three blades are depicted in this view.

The plurality of blades can each have a length from 1 foot and 3 feet and in embodiments are slightly less than 50 percent the width of the an outer ring 1008 in the tank. Each blade can in embodiments, be oriented at an angle of 45 percent of a longitudinal axis of the tank to push drill cuttings or waste out towards the outer ring 1008.

The low horsepower controllable central sweep motor 214 can be connected to the central sweep member 240 and can rotate the plurality of blades 242*a*-242*c* for cutting segments of drill cuttings or waste in the tank 204.

The controller 215 is depicted in communication with the low horsepower controllable central sweep motor 214. In one or more embodiments, the controller can also be in communication with the vent valve and the discharge valve.

A moveable weir 244 can be used for adjusting the volume of drill cuttings or waste to be cut by the plurality of blades in the tank. The moveable weir is adjusted using the weir controller 210.

Gear reduction equipment 246 amplifies torque from the low horsepower controllable central sweep motor to initiate rotation of the plurality of blades, allowing the plurality of blades to cut the waste or drill cuttings.

FIG. 4 also shows an outer ring 1008 with a plurality of peripheral sweep members 180*a*. The plurality of peripheral sweep members can be mounted to the outer ring in a plane identical to the plurality of blades of the central sweep member.

The outer ring 1008 and the plurality of peripheral sweep members 180*a* are for clearing cut waste and flowing the cut waste to the discharge port 209.

In embodiments, the outer ring 1008 can range in size from 250 mm to 500 mm in diameter.

The peripheral sweep members can each be from 3 inches to 20 inches in length. Each peripheral sweep member can have a thickness from ¼ of an inch to 2 inches. In embodiments, the peripheral sweep members can be mounted at a 90 degree angle from the outer ring.

Also depicted is the first outgoing transportation device 116 that can be in fluid communication with the discharge valve 212.

The first outgoing transportation device 116 can be a dense phase conveyance system (also known as a "DPCS"), a vacuum conveyance system, a dilute conveyance system, an auger, or combinations thereof, for communicating cut waste or drill cuttings from the tank.

In one or more embodiments, the system can use a network 248 to bidirectional communicate with the controller 215.

The network 248 allows the controller 215 to communicate drill cutting and waste disposal information to client devices 250 that are connected to the network. The client devices can perform for data acquisition and analysis. In embodiments, the client devices can be laptops, cell phones, or other devices with a processor, data storage and a display, such as a computer. In embodiments, the client devices can be remote to the rig buffer storage.

Figure 5A:
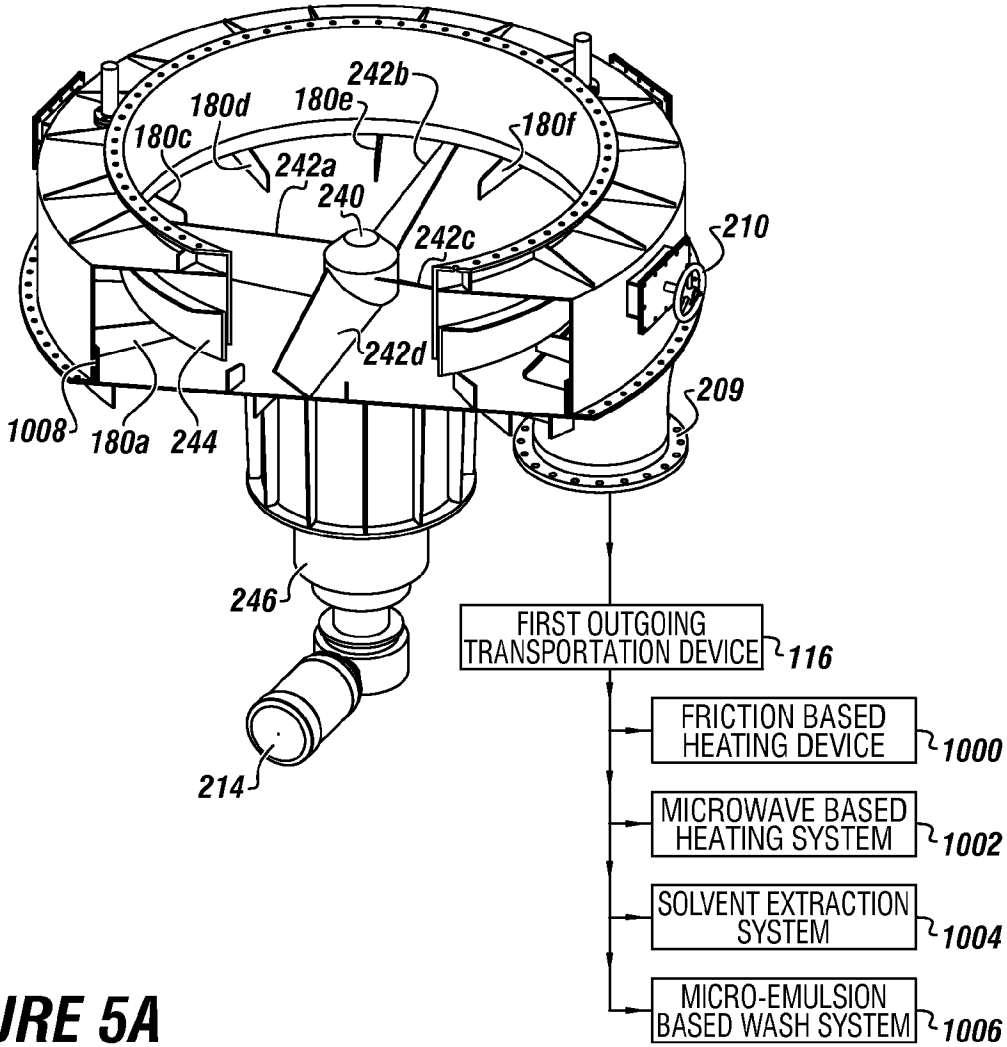
FIG. 5A is a partial sectional view of the central sweep member and associated apparatus of the rig buffer storage as connected to a transportation device.
Figure 5B:
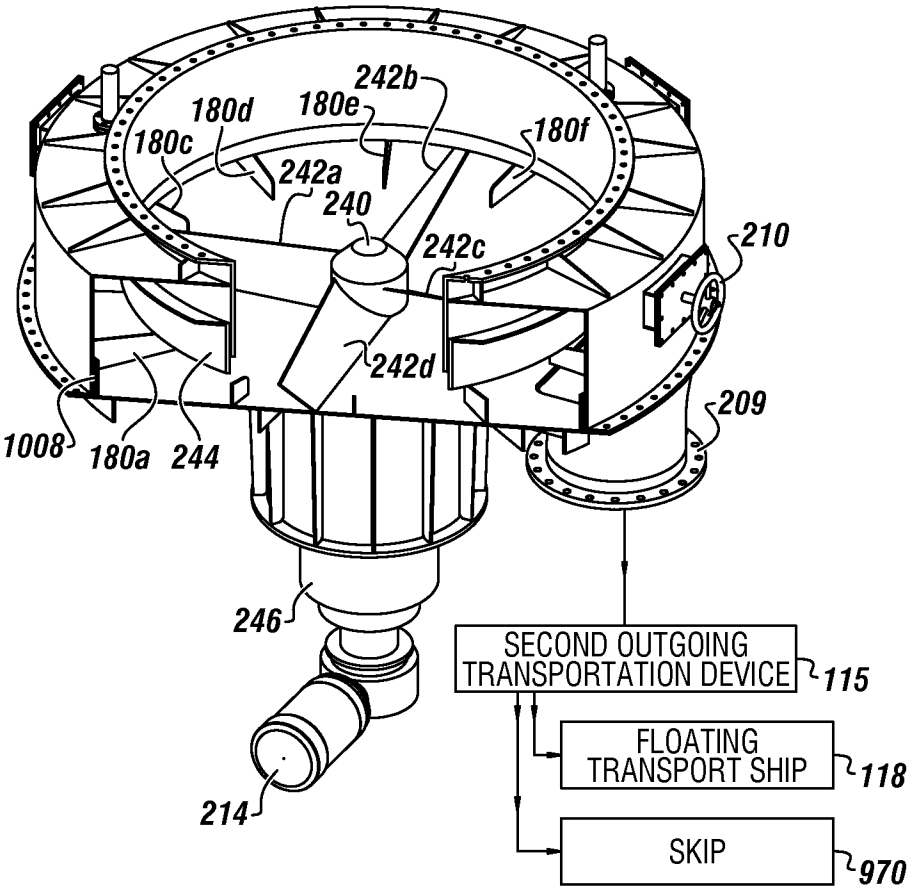
FIG. 5B is partial sectional view of the central sweep member and associated apparatus of the rig buffer storage as connected to a floating vessel or skips.

FIG. 5A is a partial sectional view of the central sweep member and associated apparatus of the rig buffer storage as connected to a transportation device. FIG. 5B is partial sectional view of the central sweep member and associated apparatus of the rig buffer storage as connected to a floating vessel or skips.

Both FIGS. 5A and 5B shows a hybrid perspective cut away view with diagrammed elements connected thereto.

Both Figures show central sweep member 240 flowing the cut material to an outgoing transportation device 116 and 115 respectively.

The outer ring 1008 and the plurality of peripheral sweep members 180*a*-180*f* are for clearing cut waste and flowing the cut waste to the discharge port 209. The plurality of peripheral sweep members 180*a*-180*f* can be in a plane identical to the plurality of blades 242*a*-242*d* of the central sweep member.

The gear reduction equipment 246 is shown connected to the low horsepower controllable central sweep motor 214. The central sweep motor 214 can be explosion proof in embodiments.

The moveable weir 244 is shown and can be adjustable by the weir controller 210. The weir controller 210 can raise or lower the moveable weir 244 adjusting the volume of drill cuttings or waste to be cut by the plurality of blades 242*a*-242*d*.

In one or more embodiments, the central sweep member can have four blades. In other embodiments, the central sweep member can have from two to eight blades. In additional embodiments, the central sweep member in the rig buffer or the transportation surge vessel, or combinations thereof can have from two to eight blades.

The moveable weir 244 can be an adjustable ring that adjustably controls a volume of drill cuttings and waste to the central sweep member by controlling the thickness of waste being cut by each rotation of the central sweep member.

FIG. 5A shows the first outgoing transportation device 116 connected to a friction based heating system 1000 to strip oil from the cuttings or waste. A usable friction based heating system can be a hammer mill.

FIG. 5A shows the first outgoing transportation device 116 connected to a microwave based heating system 1002 to strip oil from the drill cuttings or waste. A usable microwave based heating system 1002 can use microwaves, such as those in a microwave oven, 75 to 200 kilowatts, to heat the drill cuttings to vaporize the oil and carry the oil off with steam and then distill the oil and water separately to usable streams.

FIG. 5A shows the first outgoing transportation device 116 connected to a solvent extraction system 1004. Solvent extraction systems use chemical to strip the oil from the particulate, such as using benzene or toluene to strip the oil off and create "cleaned particulate" waste. Many suppliers create solvent extraction systems for removing oil from particulate and most would be usable in this closed loop system.

FIG. 5A shows the first outgoing transportation device 116 connected to or a micro-emulsion based wash system 1006 for treating the drill cuttings and waste to remove oil from the drill cuttings and waste. For example, a usable micro-emulsion based wash system can be one that is available from SAS of the United Kingdom.

FIG. 5B shows the same parts as FIG. 5A for of the rig buffer storage, however, in this embodiment; a second outgoing transportation device 115 is fluidly connected to the rig buffer storage.

The second outgoing transportation device 115 is for communicating cut waste or drill cuttings from the tank of the rig storage buffer and flowing the cut waste or drill cuttings to either: a skip 970 positioned nearby for receiving the cut waste or drill cuttings from the outgoing transportation device which is then loaded on a floating transport ship; or a floating transport ship fluidly connected to the oil and natural gas drilling or production rig for receiving the cut waste or drill cuttings in bulk storage containers on the floating transport ship.

The second outgoing transportation device 115 is either a dense phase conveyance system, a dense phase conveyance system with an auger, an auger, a vacuum conveyance system, or combinations thereof.

Figure 6:
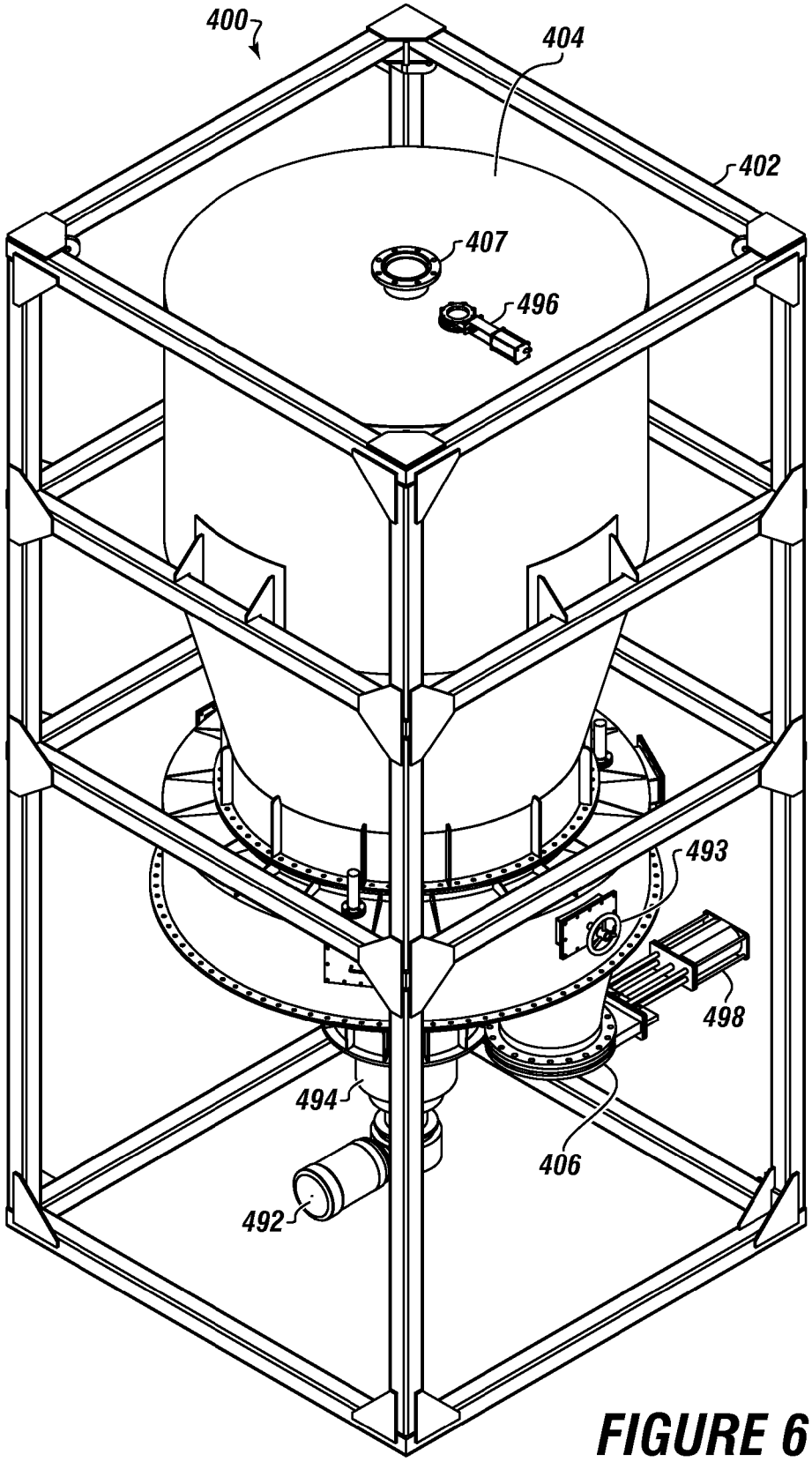
FIG. 6 is a perspective view of a surge tank usable with the rig buffer storage according to an embodiment of the invention.

FIG. 6 depicts a surge tank assembly 400 mounted on the deck.

In embodiments, the surge tank assembly 400 can be disposed between (a) a second incoming transport system shown in FIG. 1B in communication with the wellbore and (b) the first incoming transport system shown in FIG. 2, communicating directly with the rig buffer storage.

The surge tank assembly 400 can have a surge tank frame 402, a surge tank 404, and a surge tank discharge port 406. The surge tank 404 can have a surge tank upper tank inlet 407 and a surge tank discharge valve 498.

The surge tank assembly 400 has a surge tank vent 496, a surge tank low horsepower controllable central sweep motor 492 and a surge tank gear reduction equipment 494 for amplifying torque from the surge tank low horsepower controllable central sweep motor 492 to initiate rotation of the plurality of surge tank blades, allowing the plurality of surge tank blades to cut the waste or drill cuttings.

Also shown in this Figure is a surge tank weir controller 493 for adjusting the volume of drill cuttings or waste in the surge tank moveable weir to be cut by the plurality of blades.

Figure 7:
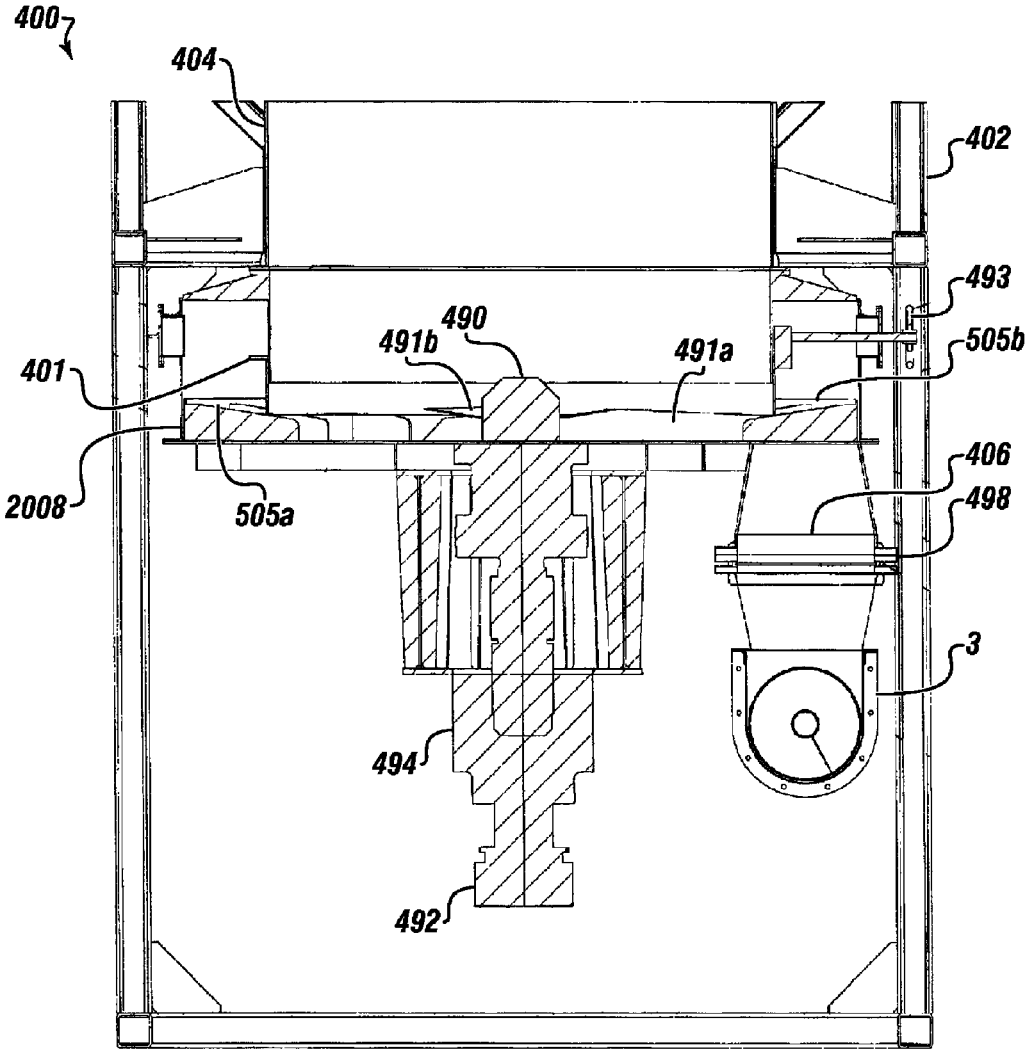
FIG. 7 is a side view of an embodiment of the rig buffer according to the present invention.

FIG. 7 shows the internals of the surge tank assembly 400 with a surge tank central sweep member 490 having a plurality of surge tank blades 491*a* and 491*b* being depicted for cutting segments of drill cuttings or waste in the surge tank 404.

Also shown in this Figure is the surge tank low horsepower controllable central sweep motor 492 connected to the surge tank central sweep member 490 for rotating the plurality of surge tank blades.

A surge tank moveable weir 401 and a surge tank weir controller 493 for adjusting the volume of drill cuttings or waste to be cut by the plurality of surge tank blades.

Also depicted is surge tank gear reduction equipment 494 for amplifying torque from the surge tank low horsepower controllable central sweep motor 492 to initiate rotation of the plurality of surge tank blades, allowing the plurality of surge tank blades to cut the waste or drill cuttings.

The surge tank frame 402, the surge tank discharge port 406, and the surge tank discharge valve 498 are disposed in the surge tank assembly 400.

In embodiments, the surge tank can be smaller in volume than the rig buffer tank.

The surge tank contains surge tank peripheral sweep members 505*a* and 505*b*.

The surge tank has a surge tank outer ring 2008 secured to a plurality of the surge tank peripheral sweep members 505*a* and 505*b* in a plane identical to the plurality of surge tank blades. The surge tank outer ring 2008 and the surge tank peripheral sweep members 505*a* and 505*b* are for clearing cut waste and flowing the cut waste to the surge tank discharge port 406.

In one or more embodiments, the surge tank can communicate to the first incoming transportation device 3.

Figure 8:
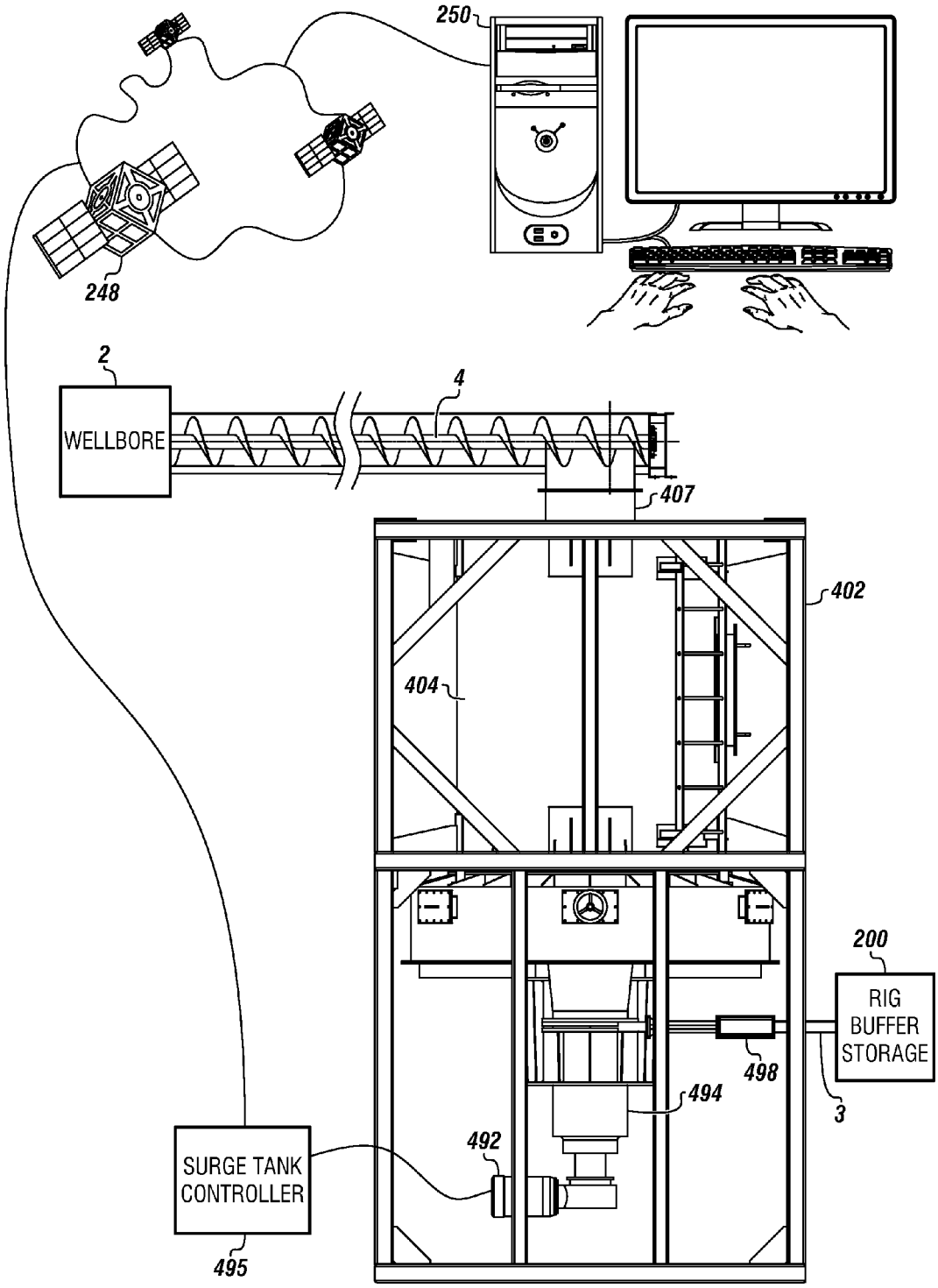
FIG. 8 is a side view of a system with a plurality of rig buffer storage.

FIG. 8 shows another view of the surge tank 404 in the surge tank frame 402, and the surge tank discharge valve 498.

The surge tank has a surge tank upper tank inlet 407 connected to a second incoming transportation system 4 which can be an auger or a trough connected to the wellbore 2.

The surge tank gear reduction equipment 494 can be connected to a surge tank motor 492 which is run by a surge tank controller 495.

The surge tank can be connected to incoming transportation system 3. The first incoming transportation system 3 goes to the rig buffer storage 200.

The surge tank controller 495 can communicate to the network 248 as well to communicate to the client device 250.

Figure 9:
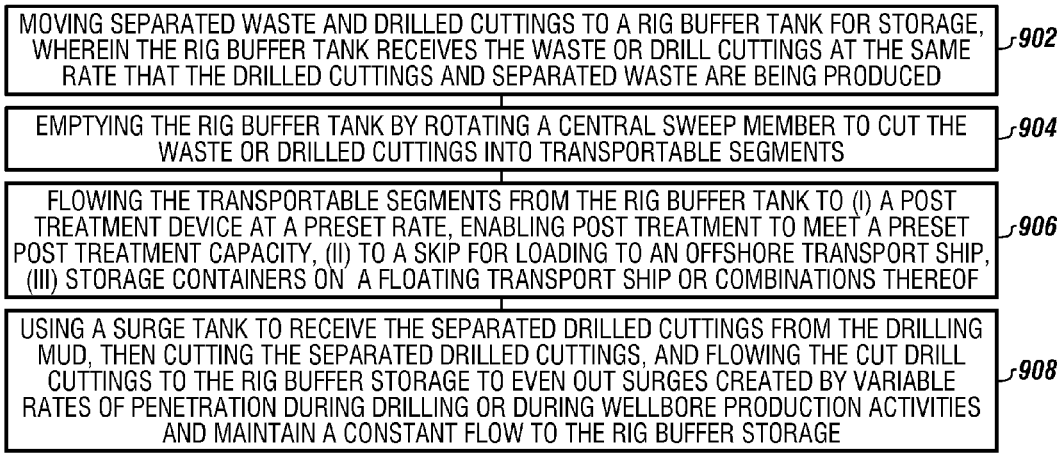
FIG. 9 is a sequence of steps used to operate this system.

FIG. 9 shows a method for transporting drill cuttings or waste using a closed loop waste transportation system.

The first step of this method, Step 902 involves moving separated waste and drilled cuttings to a rig buffer tank for storage, wherein the rig buffer tank receives the waste or drill cuttings at the same rate that the drilled cuttings and separated waste are being produced.

Step 904 involves emptying the rig buffer tank by rotating a central sweep member to cut the waste or drilled cuttings into transportable segments.

Step 906 involves flowing the transportable segments from the rig buffer tank to (i) a post treatment device at a preset rate, enabling post treatment to meet a preset post treatment capacity, (ii) to a skip for loading to an offshore transport ship, (iii) storage containers on a floating transport ship or combinations thereof.

Additionally a Step 908 can be used that involves using a surge tank to receive the separated drilled cuttings from the drilling mud, then cutting the separated drilled cuttings, and flowing the cut drill cuttings to the rig buffer storage to even out surges created by variable rates of penetration during drilling or during wellbore production activities and maintain a constant flow to the rig buffer storage.

FIG. 10A depicts a cut away view of an upper portion of the tank of the rig buffer storage depicting the tangential entry of the inlet. FIG. 10B depicts a sectional view of the upper portion of the tank of FIG. 10A.

In embodiments, the inlet to the rig buffer tank has a tangential entry to the rig buffer tank in line with the radius of the tank for receiving waste and drilled cuttings from the first incoming transportation system.

The rig buffer storage, if it has the tangential entry can further include a vortex finder 218 mounted centrally in an upper portion of the rig buffer tank to create a circular flow around a circumference of the tank 204. The tank 204 is contained in the lifting frame 202. The tank 204 has an upper tank inlet 206.

In embodiments, the vortex finder 218 can be mounted centrally in an upper portion of the rig buffer storage tank to create a circular flow of waste or drilling cutting around a circumference of the rig buffer tank.

Other embodiments of the system contemplate the rig buffer storage tank having a baffle 220 connected between the vortex finder 218 and an inner wall 222 of the tank for enhancing the circular flow of the waste or drilling cuttings around a circumference of the rig buffer tank. A vent valve 216 is also depicted.

Figure 11:
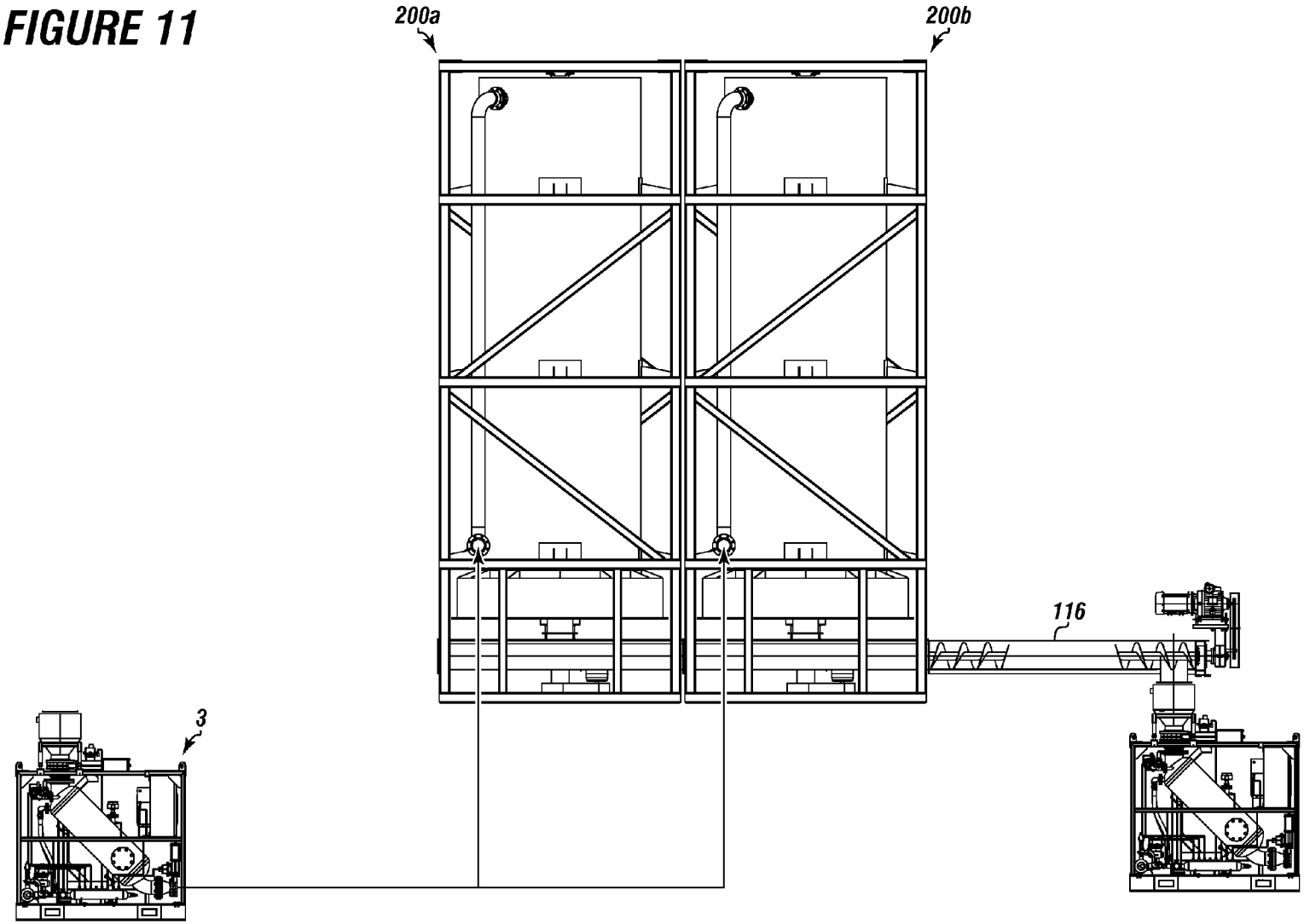
FIG. 11 depicts a plurality of the rig buffer storages used in series.

FIG. 11 shows an embodiment having a plurality of rig buffer storage 200*a* and 200*b* connected in series between the first incoming transportation system 3 and the first outgoing transportation device 116.

While these embodiments have been described with emphasis on the embodiments, it should be understood that within the scope of the appended claims, the embodiments might be practiced other than as specifically described herein.

What is claimed is:

1. A clog free waste removal system for removing waste or drilling cuttings from a wellbore at the rate that waste is being produced, the clog free waste removal system comprising:

a. a first incoming transportation system for receiving separated drill cuttings, waste, or combinations thereof, from a solids removal system associated with a natural gas, oil or other well, wherein the first incoming transportation system comprises: a dense phase conveyance system, a vacuum conveyance system, a dilute conveyance system, an auger, or combinations thereof;

b. a rig buffer storage connected to the first incoming transportation system, wherein the rig buffer storage comprises:
   (i) a lifting frame;
   (ii) a tank supported by the lifting frame, wherein the tank receives the drill cuttings or waste from the first incoming transportation system via an upper tank inlet, a lower tank inlet, or combinations thereof; and further wherein the tank discharges drill cuttings or cut waste through a discharge port;
   (iii) a central sweep member having a plurality of blades for cutting segments of drill cuttings or waste in the tank;
   (iv) a low horsepower controllable central sweep motor connected to the central sweep member for rotating the plurality of blades;
   (v) a moveable weir in the tank for adjustably containing a volume of drill cuttings or waste to be cut by the plurality of blades;
   (vi) a weir controller for adjusting a height of the moveable weir;
   (vii) a gear reduction equipment for amplifying torque from the low horsepower controllable central sweep motor to initiate rotation of the plurality of blades, allowing the plurality of blades to cut the waste or drill cuttings;
   (viii) a controller in communication with the low horsepower controllable central sweep motor, a vent valve, and a discharge valve;
   (ix) an outer ring with a plurality of peripheral sweep members in a plane identical to the plurality of blades of the central sweep member, wherein the outer ring and peripheral sweep members are for clearing cut waste and flowing the cut waste to the discharge port; and c. a first outgoing transportation device in communication with the rig buffer storage; comprising a dense phase conveyance system, a vacuum conveyance system, a dilute conveyance system, an auger, or combinations thereof, for communicating cut waste or drill cuttings from the tank; and d. a post treatment device, or a moveable, relocatable skip fluidly connected to the first outgoing transportation device for receiving the cut waste or drill cuttings from the first outgoing transportation device; further wherein the post treatment device is selected from the group:
   (i) a friction based heating system to strip oil from the cuttings or waste;
   (ii) a microwave based heating system to strip oil from the drill cuttings or waste;
   (iii) a solvent extraction system; or
   (iv) a micro-emulsion based wash system for treating the drill cuttings and waste to remove oil from the drill cuttings and waste.

2. The clog free waste removal system of claim 1, further comprising a surge tank assembly disposed between (a) a second incoming transportation system which is in communication with the wellbore and (b) the first incoming transportation system engaging the rig buffer storage.

3. The clog free waste removal system of claim 2, wherein the surge tank assembly comprises:

a. a surge tank frame;

b. a surge tank contained in the surge tank frame with a surge tank upper tank inlet and a surge tank discharge port;

c. a surge tank moveable weir disposed in the surge tank;

d. a surge tank central sweep member having a plurality of surge tank blades for cutting segments of drill cuttings or waste in the surge tank;

e. a surge tank low horsepower controllable central sweep motor connected to the surge tank central sweep member for rotating the plurality of surge tank blades;

f. a surge tank outer ring with a plurality of surge tank peripheral sweep members in a plane identical to the plurality of surge tank blades of the surge tank central sweep member, wherein the surge tank outer ring and surge tank peripheral sweep members are for clearing cut waste and flowing the cut waste to the surge tank discharge port;

g. a surge tank weir controller for adjusting the volume of drill cuttings or waste in the surge tank moveable weir to be cut by the plurality of blades;

h. a surge tank gear reduction equipment for amplifying torque from the surge tank low horsepower controllable central sweep motor to initiate rotation of the plurality of surge tank blades, allowing the plurality of surge tank blades to cut the waste or drill cuttings; and i. a surge tank controller in communication with the surge tank low horsepower controllable central sweep motor, a surge tank vent valve, and a surge tank discharge valve, and further wherein a volume of the surge tank is smaller in volume than a volume of the rig buffer tank.

4. The clog free waste removal system of claim 2, wherein the plurality of blades in the rig buffer or surge tank comprises 2 blades to 8 blades.

5. The clog free waste removal system of claim 1, wherein the inlet to the rig buffer tank has a tangential entry to the rig buffer tank from the incoming transportation system and further comprises a vortex finder mounted centrally in an upper portion of the rig buffer tank to create a circular flow of waste or drilling cuttings around a circumference of the rig buffer tank.

6. The clog free waste removal system of claim 5, further comprising a baffle connected between the vortex finder and an inner wall of the tank for enhancing the circular flow of the waste or drilling cuttings around a circumference of the rig buffer tank.

7. The clog free waste removal system of claim 1, wherein the moveable weir is an adjustable ring that controls a volume of waste or drilling cuttings to be cut by each rotation of the central sweep member.

8. The clog free waste removal system of claim 1, further comprising a plurality of rig buffer storage units connected in series between the incoming transportation system and one of the outgoing transportation devices.

9. The clog free waste removal system of claim 1, further comprising a network in communication with the controller for communicating cutting and waste disposal information to client devices for data acquisition and analysis connected to the network, wherein the client devices are remote to the rig buffer storage.

10. A clog free waste removal system for removing waste or drilling cuttings from a wellbore at the rate that the waste is being produced comprising:

a. a first incoming transportation system for receiving separated drill cuttings, waste, or combinations thereof, from a solids removal system wherein the incoming transportation system comprises a dense phase conveyance system, a vacuum conveyance system, a dilute conveyance system, an auger, or combinations thereof;

b. a rig buffer storage connected to the first incoming transportation system comprising:

(i) a lifting frame;

(ii) a tank supported by the lifting frame, wherein the tank receives the drill cuttings or waste from the first incoming transportation system via an upper tank inlet, a lower tank inlet, or combinations thereof; and further wherein the tank discharges cuttings or cut waste through a discharge port;

(iii) a central sweep member having a plurality of blades for cutting segments of drill cuttings or waste in the tank;

(iv) a low horsepower controllable central sweep motor connected to the central sweep member for rotating the plurality of blades;

(v) a moveable weir in the tank for adjustably containing a volume of drill cuttings or waste to be cut by the plurality of blades;

(vi) a weir controller for adjusting a height of the moveable weir;

(vii) a gear reduction equipment for amplifying torque from the low horsepower controllable central sweep motor to initiate rotation of the plurality of blades, allowing the plurality of blades to cut the waste or drill cuttings;

(viii) a controller in communication with the low horsepower controllable central sweep motor and a vent valve, and a discharge valve;

(ix) an outer ring with a plurality of peripheral sweep members in a plane identical to the plurality of blades of the central sweep member, wherein the outer ring and peripheral sweep members are for clearing cut waste and flowing the cut waste to the discharge port; and c. a second outgoing transportation device in fluid communication with the rig buffer storage; comprising a dense phase conveyance system, a dense phase conveyance system with an auger, an auger, or a vacuum conveyance system, or combinations thereof, for communicating cut waste or drill cuttings from the tank and flowing the cut waste or drill cuttings to either:

(i) a movable, relocatable skip positioned nearby for receiving the cut waste or drill cuttings from the outgoing transportation device which is then loaded on a floating transport ship; or (ii) a floating transport ship fluidly connected to the oil and natural gas drilling or production rig for receiving the cut waste or drill cuttings in bulk storage containers on the floating transport ship.

11. The clog free waste removal system of claim 10, further comprising a surge tank assembly disposed between (a) a second incoming transportation system which is in communication with the wellbore and (b) the first incoming transportation system engaging the rig buffer storage.

12. The clog free waste removal system of claim 11, wherein the surge tank assembly comprises:

a. a surge tank frame;

b. a surge tank contained in the surge tank frame with a surge tank upper tank inlet and a surge tank discharge port;

c. a surge tank moveable weir disposed in the surge tank;

d. a surge tank central sweep member having a plurality of surge tank blades for cutting segments of drill cuttings or waste in the surge tank;

e. a surge tank low horsepower controllable central sweep motor connected to the surge tank central sweep member for rotating the plurality of surge tank blades;

f. a surge tank outer ring with a plurality of surge tank peripheral sweep members in a plane identical to the plurality of surge tank blades of the surge tank central sweep member, wherein the surge tank outer ring and surge tank peripheral sweep members are for clearing cut waste and flowing the cut waste to the surge tank discharge port;

g. a surge tank weir controller for adjusting the volume of drill cuttings or waste in the surge tank moveable weir to be cut by the plurality of blades;

h. a surge tank gear reduction equipment for amplifying torque from the surge tank low horsepower controllable central sweep motor to initiate rotation of the plurality of surge tank blades, allowing the plurality of surge tank blades to cut the waste or drill cuttings; and i. a surge tank controller in communication with the surge tank low horsepower controllable central sweep motor, a surge tank vent valve, and a surge tank discharge valve that controls the surge tank discharge, and further wherein a volume of the surge tank is smaller in volume than a volume of the rig buffer tank.

13. The clog free waste removal system of claim 12, wherein the plurality of blades in the rig buffer or surge tank comprises 2 blades to 8 blades.

14. The clog free waste removal system of claim 10, wherein the inlet to the rig buffer tank has a tangential entry to the rig buffer tank from the incoming transportation system and further comprises a vortex finder mounted centrally in an upper portion of the rig buffer tank to create a circular flow of waste or drilling cuttings around a circumference of the rig buffer tank.

15. The clog free waste removal system of claim 14, further comprising a baffle connected between the vortex finder and an inner wall of the tank for enhancing the circular flow of the waste or drilling cuttings around the circumference of the rig buffer tank.

16. The clog free waste removal system of claim 10, wherein the moveable weir is an adjustable ring that controls a volume of waste or drilling cuttings to be cut by each rotation of the central sweep member.

17. The clog free waste removal system of claim 10, further comprising a plurality of rig buffer storage units connected in series between the incoming transportation system and one of the outgoing transportation devices.

18. The clog free waste removal system of claim 10, further comprising a network in communication with the controller for communicating cutting and waste disposal information to client devices for data acquisition and analysis connected to the network, wherein the client devices are remote to the rig buffer storage.

* * * * *